US009920581B2

(12) United States Patent
Bratschke

(10) Patent No.: US 9,920,581 B2
(45) Date of Patent: Mar. 20, 2018

(54) ELECTROMAGNETIC DIRECTIONAL COUPLER WIRED PIPE TRANSMISSION DEVICE

(71) Applicant: Thomas Bratschke, Garbsen (DE)

(72) Inventor: Thomas Bratschke, Garbsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 419 days.

(21) Appl. No.: 14/187,923

(22) Filed: Feb. 24, 2014

(65) Prior Publication Data

US 2015/0240568 A1 Aug. 27, 2015

(51) Int. Cl.

| | |
|---|---|
| ***G01V 3/00*** | (2006.01) |
| ***E21B 17/00*** | (2006.01) |
| ***E21B 17/02*** | (2006.01) |
| ***E21B 47/12*** | (2012.01) |

(52) U.S. Cl.
CPC ..... *E21B 17/003* (2013.01); *E21B 17/028* (2013.01); *E21B 47/122* (2013.01)

(58) Field of Classification Search
CPC ..... E21B 47/12; E21B 47/122; E21B 44/00; E21B 47/00; E21B 41/0021
See application file for complete search history.

(56) References Cited

U.S. PATENT DOCUMENTS 2,858,108 A * 10/1958 Wise ..... E21B 7/24 175/103
2,890,757 A * 6/1959 Bodine ..... E21B 31/005 166/177.1
2,903,242 A * 9/1959 Bodine, Jr. ..... E21B 7/24 173/49
2,970,660 A * 2/1961 Bodine, Jr. ..... E21B 7/24 173/49
2,989,130 A * 6/1961 Mathewson, Jr. ..... E21B 7/24 175/56
3,550,042 A * 12/1970 Werlau ..... H03H 7/48 333/112
4,216,446 A * 8/1980 Iwer ..... H01P 5/185 333/112
4,605,268 A 8/1986 Meador
4,712,070 A * 12/1987 Clark ..... G01V 3/28 324/333

(Continued)

FOREIGN PATENT DOCUMENTS

WO 2009143409 A2 11/2009
WO 2013062949 A1 5/2013

OTHER PUBLICATIONS

Gary Bold, "The Bruene Directional Coupler and Transmission Lines", Version 1.3 Ocober 18, 2009, 19 pages.

(Continued)

*Primary Examiner* — Joseph Feild
*Assistant Examiner* — Rufus Point
(74) *Attorney, Agent, or Firm* — Cantor Colburn LLP

(57) ABSTRACT

A wired pipe assembly includes a first wired pipe segment including a first body extending from a first box end to a first pin end and a second wired pipe segment including a second body extending from a second box end to a second pin end. The assembly also includes an electromagnetic directional coupler including an input line disposed in the first wired pipe segment and an output line disposed in the second wired pipe segment.

20 Claims, 6 Drawing Sheets

(56) References Cited

U.S. PATENT DOCUMENTS 4,788,544 A 11/1988 Howard
5,424,694 A * 6/1995 Maloratsky ..... H01P 5/185 333/112
5,574,374 A * 11/1996 Thompson ..... G01V 3/28 324/338
5,592,438 A * 1/1997 Rorden ..... E21B 47/101 340/854.3
5,811,972 A * 9/1998 Thompson ..... G01V 3/30 324/338
5,850,369 A * 12/1998 Rorden ..... E21B 47/101 340/854.3
6,208,586 B1 * 3/2001 Rorden ..... E21B 47/101 181/105
6,392,317 B1 * 5/2002 Hall ..... E21B 17/003 174/47
6,445,307 B1 9/2002 Rassi et al.
6,641,434 B2 11/2003 Boyle et al.
6,670,880 B1 12/2003 Hall et al.
7,064,676 B2 * 6/2006 Hall ..... E21B 17/028 166/242.6
7,096,961 B2 8/2006 Clark et al.
7,187,910 B2 * 3/2007 Kim ..... H01P 5/185 333/109
7,362,235 B1 4/2008 Normann et al.
7,567,146 B2 * 7/2009 Tervo ..... H01P 5/183 333/109
7,821,354 B2 * 10/2010 Niiranen ..... H01P 5/187 333/116
7,913,773 B2 3/2011 Li et al.
8,077,053 B2 * 12/2011 Thompson ..... E21B 47/06 166/252.5
2004/0217880 A1 11/2004 Clark et al.
2006/0151179 A1 * 7/2006 Boyadjieff ..... E21B 17/003 166/380
2006/0260798 A1 11/2006 Hall et al.
2009/0045887 A1 * 2/2009 Tervo ..... H01P 5/183 333/111
2009/0146758 A1 * 6/2009 Niiranen ..... H01P 5/185 333/116
2009/0205820 A1 * 8/2009 Koederitz ..... E21B 10/00 166/250.01
2010/0116550 A1 * 5/2010 Hutin ..... E21B 17/003 175/40
2010/0215327 A1 8/2010 Braden et al.
2010/0264650 A1 10/2010 Braden et al.
2011/0057810 A1 3/2011 Partouche et al.
2011/0292763 A1 12/2011 Coates et al.
2012/0176138 A1 * 7/2012 Prammer ..... E21B 17/003 324/338
2013/0106615 A1 * 5/2013 Prammer ..... G01V 3/30 340/854.6
2015/0240568 A1 * 8/2015 Bratschke ..... E21B 17/003 166/244.1

OTHER PUBLICATIONS

Notification of Transmittal of the International Search Report and the Written Opinion of the International Searching Authority, or the Declaration; PCT/US2015/017275; Jun. 3, 2015, 14 Pages.
Pixton, "Very High-Speed Drill String Communications Network", Novatek, Final Technical Report, Jun. 2005, 59 pages.
Avionics Dept of the Naval Air Warfare Center Weapons Division, "Electronic Warfare and Radar Systems Engineering Handbook (report No. TS 92-78)" (retrieved on Jun. 9, 2006) (pp. 6-4.1 to 6-4.5 Power Dividers and Directional Couplers). Retrieved from the internet:URL:http://en.wikipedia.org/wiki/Power_dividers_and_directional_couplers, 15 pages.
M/A-COM, RF Directional Couplers and 3dB Hybrids Overview M560, [retrieved on Jul. 11, 2015 (Jul. 11, 2015)]. Retrieved from the internet:,URL: www.ieee.li/pdf/essay/directional_couplers.pdf, 10 pages.
Extended European Search Report for International Application No. 15752895.1 dated Nov. 2, 2017, 8 pages.

* cited by examiner

ELECTROMAGNETIC DIRECTIONAL COUPLER WIRED PIPE TRANSMISSION DEVICE

BACKGROUND

During subterranean drilling and completion operations, a pipe or other conduit is lowered into a borehole in an earth formation during or after drilling operations. Such pipes are generally configured as multiple pipe segments to form a "string", such as a drill string or production string. As the string is lowered into the borehole, additional pipe segments are coupled to the string by various coupling mechanisms, such as threaded couplings.

Various power and/or communication signals may be transmitted through the pipe segments via a "wired pipe" configuration. Such configurations include electrical, optical or other conductors extending along the length of selected pipe segments. The conductors are operably connected between pipe segments by a variety of coupling configurations.

One such coupling configuration includes a threaded male-female configuration often referred to as a pin box connection. The pin box connection includes a male member, i.e., a "pin" that includes an exterior threaded portion, and a female member, i.e., a "box", that includes an interior threaded portion and is configured to receive the pin in a threaded connection.

Some wired pipe configurations include a transmission device mounted on the tip of the pin as well as in the box end. The transmission device, or "coupler," can transmit power, data or both to an adjacent coupler. The coupler in the pin end is typically connected via a coaxial cable to the coupler in the box end.

BRIEF DESCRIPTION

Disclosed herein is a wired pipe assembly that includes a first wired pipe segment including a first body extending from a first box end to a first pin end and a second wired pipe segment including a second body extending from a second box end to a second pin end. The assembly also includes an electromagnetic directional coupler including an input line disposed in the first wired pipe segment and an output line disposed in the second wired pipe segment.

Also disclosed is a method of transmitting a signal along a drillstring that includes a first wired pipe segment and a second wired pipe segment. The method includes: providing an input portion of a directional coupler including an input line in the first wired pipe segment; providing an output line of the directional coupler disposed in the second wired pipe segment; and providing a signal to the input line.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed system, apparatus and method are presented herein by way of exemplification and not limitation with reference to the Figures.

Figure 1:
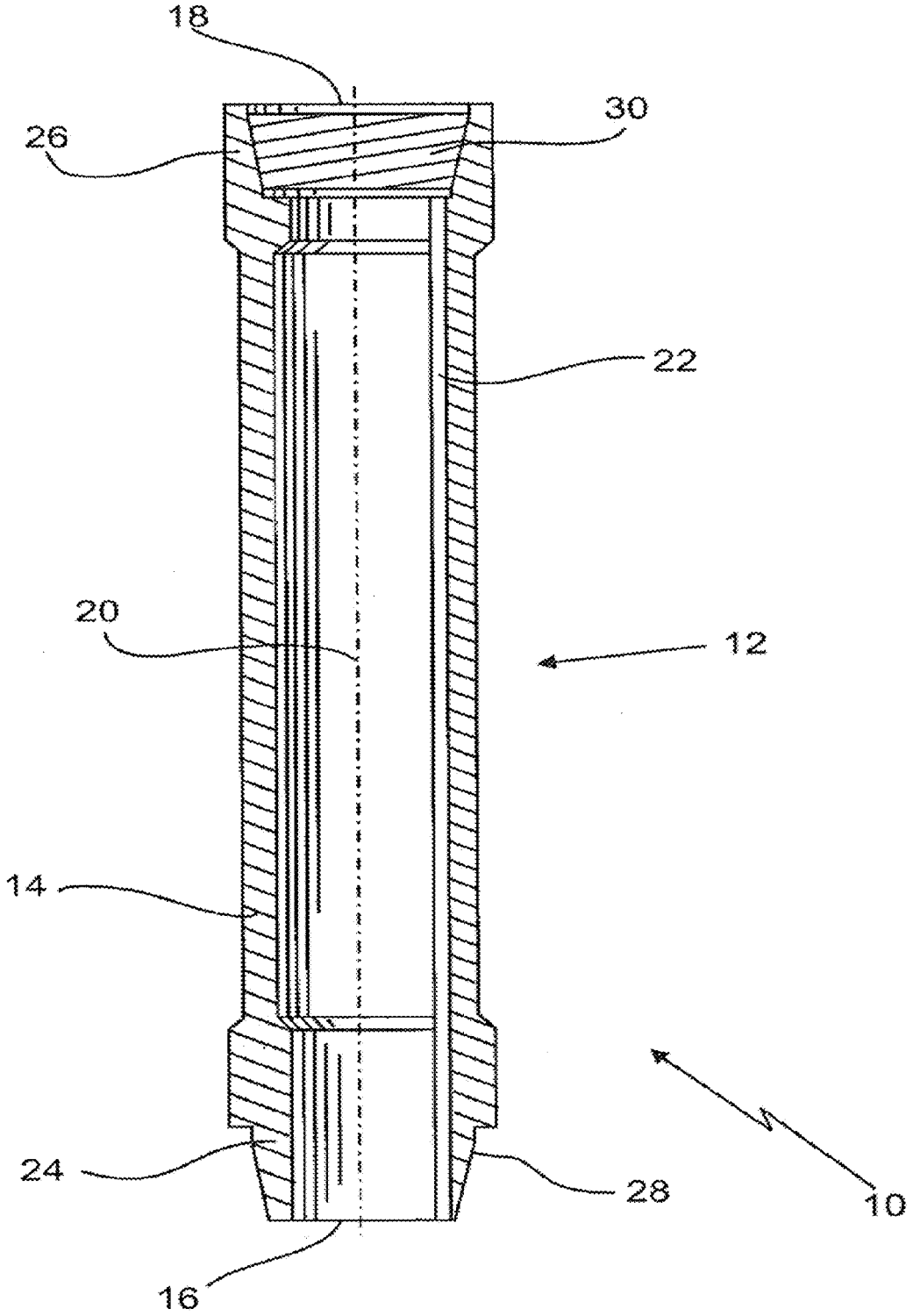
FIG. 1 depicts an exemplary embodiment of a wired pipe segment of a well drilling and/or logging system.

Referring to FIG. 1, an exemplary embodiment of a portion of a well drilling, logging and/or production system 10 includes a conduit or string 12, such as a drillstring or production string, that is configured to be disposed in a borehole for performing operations such as drilling the borehole, making measurements of properties of the borehole and/or the surrounding formation downhole, or facilitating gas or liquid production.

For example, during drilling operations, drilling fluid or drilling "mud" is introduced into the string 12 from a source such as a mud tank or "pit" and is circulated under pressure through the string 12, for example via one or more mud pumps. The drilling fluid passes into the string 12 and is discharged at the bottom of the borehole through an opening in a drill bit located at the downhole end of the string 12. The drilling fluid circulates uphole between the string 12 and the borehole wall and is discharged into the mud tank or other location.

The string 12 may include at least one wired pipe segment 14 having an uphole end 18 and a downhole end 16. As described herein, "uphole" refers to a location near the point where the drilling started relative to a reference location when the segment 14 is disposed in a borehole, and "downhole" refers to a location away from the point where the drilling started along the borehole relative to the reference location. It shall be understood that the uphole end 18 could be below the downhole end 16 without departing from the scope of the disclosure herein.

At least an inner bore or other conduit 20 extends along the length of each segment 14 to allow drilling mud or other fluids to flow therethrough. A transmission line 22 is located within the wired segment 14 to provide protection for electrical, optical or other conductors to be disposed along the wired segment 14. In one embodiment, the transmission line 22 is a coaxial cable. In another embodiment, the transmission line 22 is formed of any manner of carrying power or data, including, for example, a twisted pair. In the case where the transmission line 22 is a coaxial cable it may include an inner conductor surrounded by a dielectric material. The coaxial cable may also include a shield layer that surrounds the dielectric. In one embodiment, the shield layer is electrically coupled to an outer conductor that may be formed, for example, by a rigid or semi-rigid tube of a conductive material.

The segment 14 includes a downhole connection 24 and an uphole connection 26. The segment 14 is configured so that the uphole connection 26 is positioned at an uphole location relative to the downhole connection 24. The downhole connection 24 includes a male coupling portion 28 having an exterior threaded section, and is referred to herein as a "pin end" 24. The uphole connection 26 includes a female coupling portion 30 having an interior threaded section, and is referred to herein as a "box end" 26.

The pin end 24 and the box end 26 are configured so that the pin end 24 of one wired pipe segment 14 can be disposed within the box end 26 of another wired pipe segment 14 to effect a fixed connection therebetween to connect the segment 14 with another adjacent segment 14 or other downhole component. In one embodiment, the exterior of the male coupling portion 28 and the interior of the female coupling portion 30 are tapered. Although the pin end 24 and the box end 26 are described has having threaded portions, the pin end 24 and the box end 26 may be configured to be coupled using any suitable mechanism, such as bolts or screws or an interference fit.

In one embodiment, the system 10 is operably connected to a downhole or surface processing unit which may act to control various components of the system 10, such as drilling, logging and production components or subs. Other components include machinery to raise or lower segments 14 and operably couple segments 14, and transmission devices. The downhole or surface processing unit may also collect and process data generated by the system 10 during drilling, production or other operations.

As described herein, "drillstring" or "string" refers to any structure or carrier suitable for lowering a tool through a borehole or connecting a drill bit to the surface, and is not limited to the structure and configuration described herein. For example, a string could be configured as a drillstring, hydrocarbon production string or formation evaluation string. The term "carrier" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wireline sondes, slickline sondes, drop shots, downhole subs, BHA's and drill strings.

Figure 3:
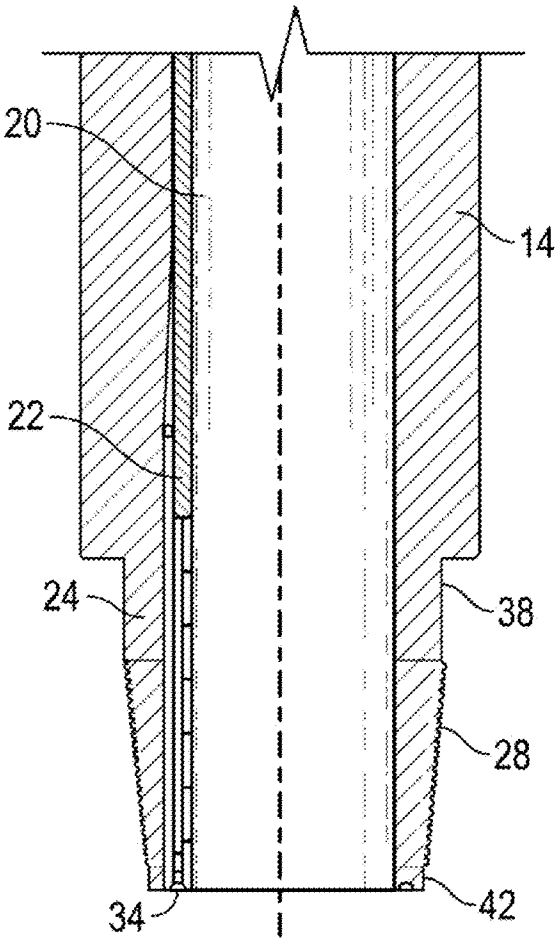
FIG. 3 depicts an exemplary embodiment of a pin connector of the segment of FIG. 1.
Figure 2:
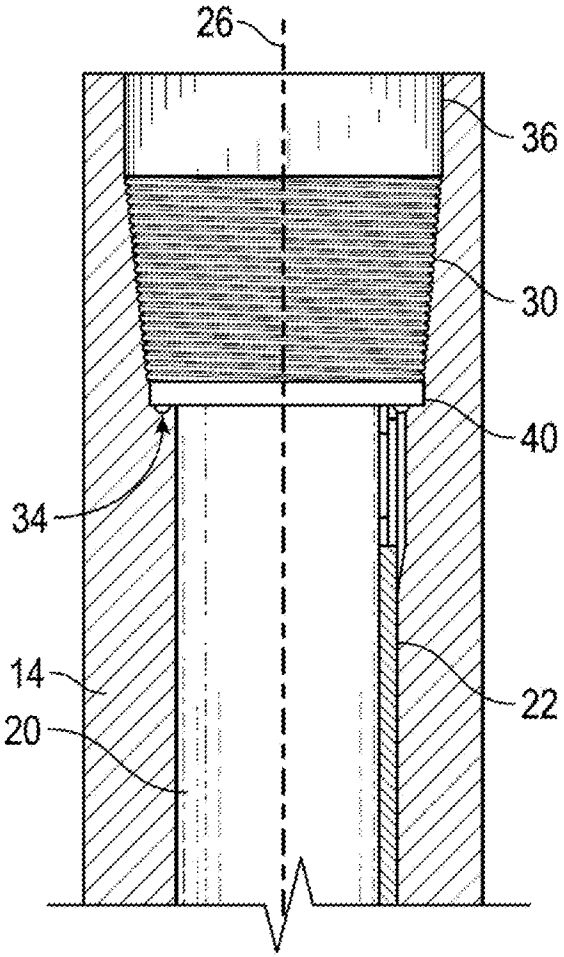
FIG. 2 depicts an exemplary embodiment of a box connector of the segment of FIG. 1.

Referring to FIGS. 2 and 3, the segment 14 includes at least one transmission device 34 (also referred to as a "coupler" herein) disposed therein and located at the pin end 24 and/or the box end 26. The transmission device 34 is configured to provide communication of at least one of data and power between adjacent segments 14 when the pin end 24 and the box end 26 are engaged. In one embodiment, the transmission device 34 is a directional coupler. In particular, the transmission device 34 may be an electromagnetic directional coupler. The coupler 34 may be disposed at the inner or outer shoulder or any other suitable location. It shall be understood that the transmission device 34 could also be included in a repeater element disposed between adjacent segments 14 (e.g, within the box end). In such a case, the data/power is transmitted from the transmission device in one segment, into the repeater. The signal may then be passed "as is," amplified, and/or modified in the repeater and provided to the adjacent segment 14.

Regardless of the configuration, it shall be understood that each transmission device 34 can be connected to one or more transmission lines 22. The connection to the transmission line could be galvanic, inductive or capacitive. The term "direct" as used with respect to a connection shall include a galvanic connection.

Figure 4A:
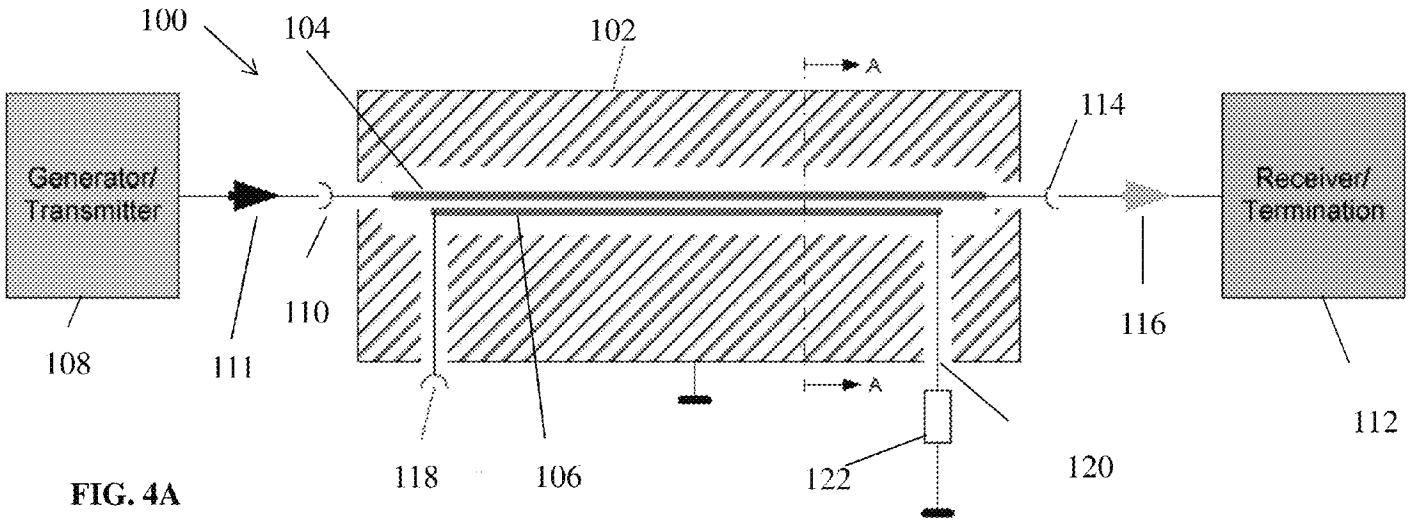
FIGS. 4A and 4B shown an example of a directional coupler.
Figure 4B:
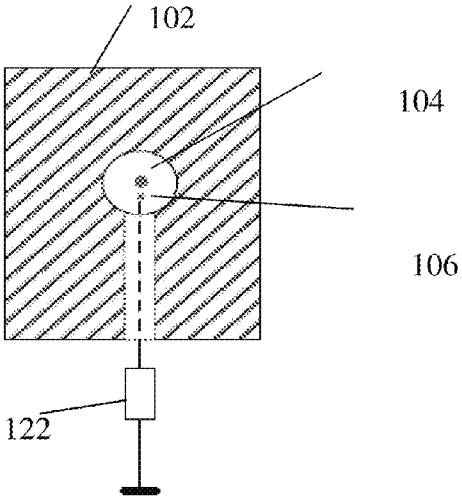

FIGS. 4A and 4B are simplified block diagrams of an electromagnetic directional coupler system 100 according to one embodiment with FIG. 4B being a cross section of FIG. 4A taken along line A-A. The illustrated system 100 includes a representation of a coupler body 102 in which an input signal is coupled from an input line 104 to an output line 106. Both input and output lines 104,106 may be formed of any type of conductive material such as, for example, a stranded wire or metallic trace. The body 102 can be formed of metallic material. In one embodiment, the body is formed from the body of a wired pipe segment 14 or a metallic material lining a cavity or groove formed in a wired pipe segment. In one embodiment, the input and output lines 104,106 are separated from each other and the coupler body 102 by one or both of a dielectric and air.

A signal generator/transmitter 108 provides the input signal to an input port 110 of the coupler body 102. The input signal (shown by arrow 112) is partially transmitted along input line 104 to a termination location 112 connected to a transmitted port 114 of the coupler body 102. The transmitted signal received at the termination location 111 is shown by arrow 116.

A portion of the power received at the input port 110 may be coupled to an output port 118. In more detail, if the length of the output line 106 is within a certain ratio (e.g., ¼) of the wavelength of a signal provided on the input line 104, a certain amount of the power on input line 104 is coupled to the output line 106. While it is not required, in one embodiment, the ratio is ¼. The length of line 106 may, or course be longer. The input line may be longer than ¼ the wavelength but not shorter. In one embodiment, the input line has a length that is ¼ the wavelength while the length of the output line 106 is longer. The coupled power is presented at output port 118. The other end of the output line 106 may be coupled to ground through a termination 122 that matches the characteristic wave impedance of the wave travelling through the coupler e.g. a grounded resistor. The termination 122 can also be a tank circuit or a transmission line with a matching impedance. This may include a resistor, a wire, a capacitor, an inductor, or any combination thereof.

The power incident upon input port 110 is partially coupled to output port 118. The ratio of the power at the output port 118 to the power at the input port 110 is referred to as the coupling ratio. If a lossless condition is assumed, then the signal splitting losses are 3 dB on both termination port 114 and output port 118. That is, the power of input signal 111 is split into two parts with the power at output port 118 and termination port 114 both being one half the power of the input signal. Of course, due to non-ideal impedance matching and dielectric losses the coupling factor may be below (worse than) 3 dB, but nevertheless power (signal) is coupled from input port 110 to the output port 118. In one embodiment, the length of the output conductor 106 is less than ¼ of the input wavelength.

Figure 5:
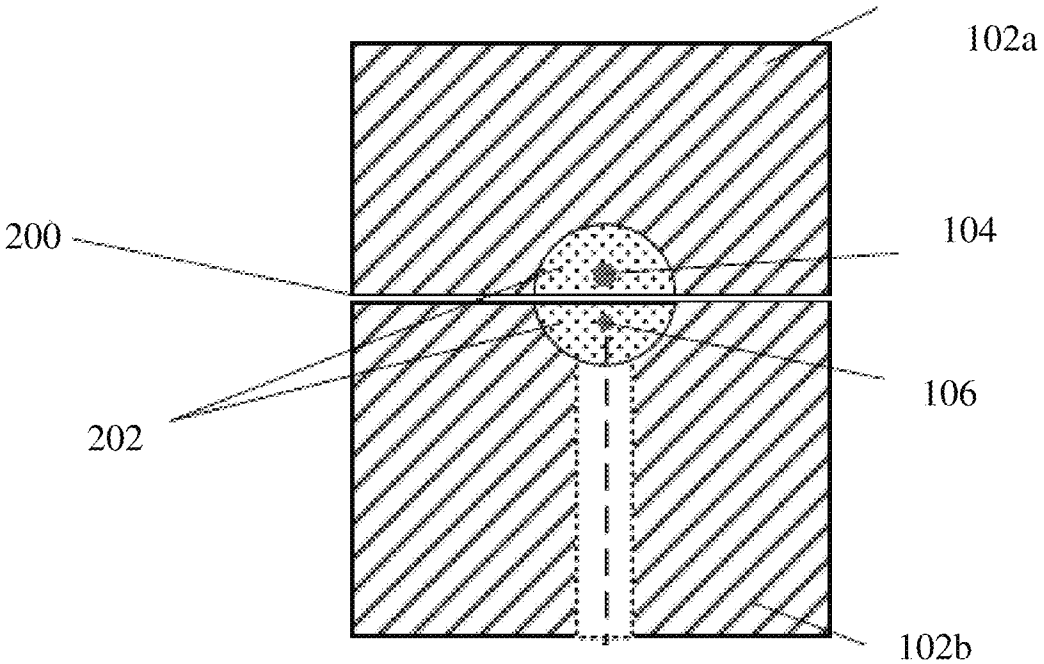
FIG. 5 shows a side view of a directional coupler implemented in a wired pipe string.
Figure 7:
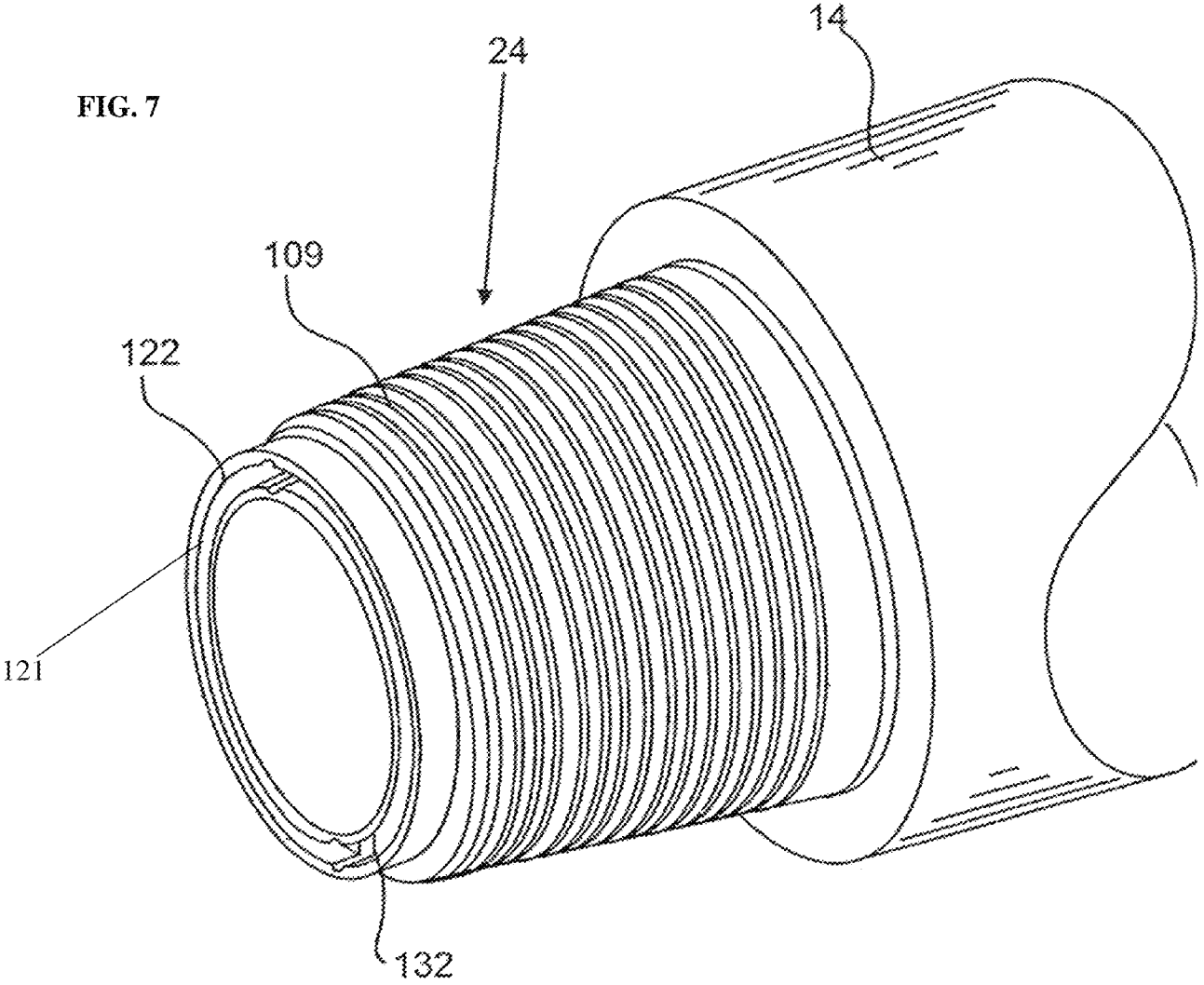
FIG. 7 illustrates a pin end having a groove formed therein.

FIG. 5 illustrates an example of how the system 100 shown in FIGS. 4A-4B may be implemented in the context of wired pipe. In particular, the body 102 is split into two parts 102*a*, 102*b*. A junction 200 is defined between the two parts 102*a*, 102*b* and while illustrated as a plane in FIG. 5 it shall be understood that the junction can take on any shape. The two parts 102*a*, 102*b* can be, respectively, the located in a groove formed in the pin end of one segment 14 and a groove formed in the box end of another segment 14, or vice versa. An example of a groove 121 is shown formed in a pin end 24 of segment 14 in FIG. 7. The groove 121 includes inner and outer walls 132 and is formed beyond threads 109. Such a groove may also be formed in the box end in, for example, an inner shoulder of the box end.

Referring again to FIG. 5, the first part 102*a* includes dielectric material 202 that holds the input line 104 in the first part 102*a*. Similarly, the second part 102*b* includes dielectric material 202 that holds the output line 106 in the second part.

Figure 6B:
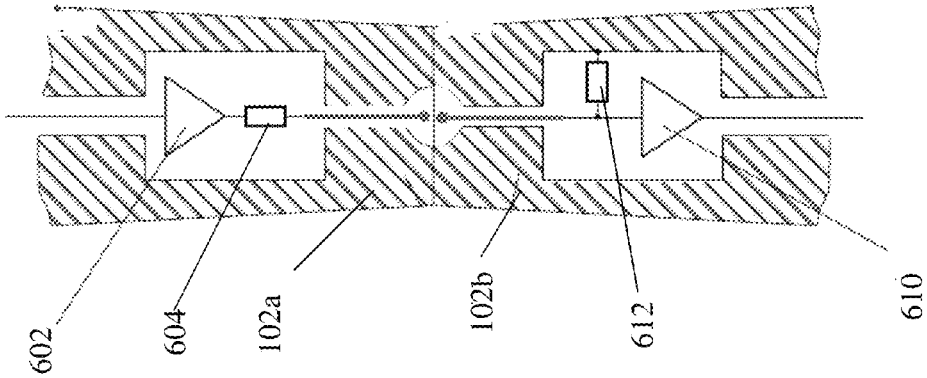
FIGS. 6A and 6B illustrate a directional coupler communication system.
Figure 6A:
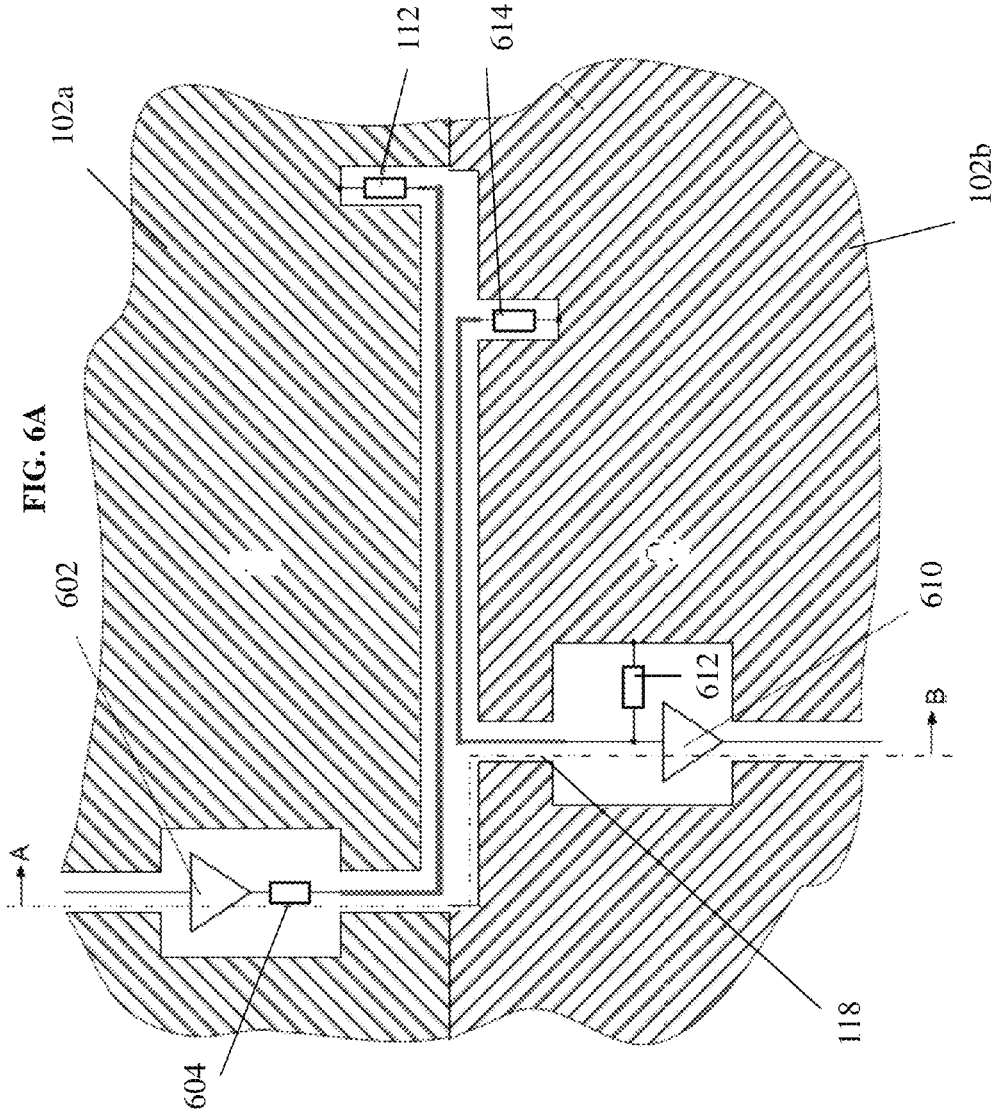

FIGS. 6A and 6B shown an example of operable system implemented in two wired pipe segments (labelled 102*a*, 102*b*) with FIG. 6B being a cross section of FIG. 6A taken along line A-B. An incoming signal is received at input 602 located in the first part 102*a* (referred to below as the first wired pipe segment 102*a*). The input 602 illustrated in FIGS. 6A and 6B is shown as an amplifier but it shall be understood that the input could be a passive element or simply a conductor such as a wire. The input 602 provides a signal to the input line 104 via an optional signal conditioner 604 such as a resistor. It shall be understood that depending on the context, the signal conditioner could include other elements such as inductors and capacitors to form a filter. Further, it shall be understood that the coupler may operate without the amplifier blocks 602 and/or 610 in each segment 14 and may only be included in cases where the signal is too weak or if the impedance of the feeding or receiving transmission lines that go from box to pin do not have the impedance of the coupler. There can also be one amplifier somewhere in the middle of the segment 14 or even every X segment. As illustrated, termination 112 is electrically coupled to the first wired pipe segment 114 and, therefore, serves to ground the input line 104 to the first wired pipe segment 102*a*. A ground separate from the first wired pipe segment 102*a* could be provided in another embodiment. The termination 112 may include a resistor, a wire, a capacitor, an inductor, or any combination thereof or a transmission line which matches the characteristic wave impedance As above, the input signal is coupled from the input line 104 to the output line 106. The signal on the output line 106 is present at output port 118 where it may optionally be amplified by output amplifier 610. Of course, the output amplifier 601 may be omitted in one embodiment. As illustrated, the output line 106 is grounded to the second wired pipe segment 102*b* via resistors 612, 614.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wired pipe assembly comprising:

a first wired pipe segment including a first body extending from a first box end to a first pin end;

a second wired pipe segment including a second body extending from a second box end to a second pin end; and an electromagnetic directional coupler including an input line disposed in the first wired pipe segment and an output line disposed in the second wired pipe segment and that is physically separated from the input line, the coupler, in operation, coupling an input electrical signal from the input line to the output line, the input line being grounded to the first wired pipe segment and the output line being grounded to the second wired pipe segment.

2. The assembly of claim 1, wherein the directional coupler includes a dielectric material separating the input line from the output line.

3. The assembly of claim 1, wherein the directional coupler includes a dielectric material surrounding the input line and the output line.

4. The assembly of claim 1, wherein the input line is disposed in a groove formed in a distal end of the first pin end and is surrounded by a dielectric material.

5. The assembly of claim 4, wherein the output line is disposed in a groove formed in an inner shoulder of the second box end and is surrounded by a dielectric material.

6. The assembly of claim 1, wherein the input line is disposed in a groove formed in an inner shoulder of the first box end and is surrounded by a dielectric material.

7. The assembly of claim 6, wherein the output line is disposed in a groove formed in a distal end of the second pin end and is surrounded by a dielectric material.

8. The assembly of claim 1, wherein one or both of the input and output lines are electrically coupled to the first wired pipe segment.

9. The assembly of claim 8, wherein a resistor is coupled between the one of the input and output lines and the first wired pipe segment.

10. The assembly of claim 1, further comprising:

an amplifier coupled to an output port of the directional coupler that amplifies an output signal of the directional coupler.

11. The assembly of claim 1, further comprising:

an amplifier coupled to an input port of the directional coupler that amplifies an input signal and provides it to the input port.

12. The assembly of claim 11, further comprising:

an amplifier coupled to an output port of the directional coupler that amplifies an output signal of the directional coupler.

13. A method of transmitting a signal along a drillstring that includes a first wired pipe segment and a second wired pipe segment, the method including:

providing a first wired pipe segment including a first body extending from a first box end to a first pin end;

providing a second wired pipe segment including a second body extending from a second box end to a second pin end; and providing an input portion of a directional coupler including an input line in the first wired pipe segment, the input line being grounded to the first wired pipe segment;

providing an output line of the directional coupler disposed in the second wired pipe segment and that is physically separated from the input line, the output line being grounded to the output line; and providing an electrical signal to the input line.

14. The method of claim 13, further comprising:

amplifying a signal at an output of the directional coupler.

15. The method of claim 14, further comprising:

receiving the amplified signal.

16. The method of claim 13, wherein providing the input portion includes disposing the input line in a dielectric disposed in a groove formed in the first wired pipe segment.

17. The method of claim 16, wherein providing the output portion includes disposing the output line in a dielectric disposed in a groove formed in the second wired pipe segment.

18. The method of claim 13, wherein a length of the output line is greater than the length of the input line.

19. The assembly of claim 1, wherein a length of the output line is greater than the length of the input line.

20. The assembly of claim 1, wherein the output line is grounded to the second wired pipe segment through a resistor.

* * * * *